US009664192B2

(12) United States Patent
Aoki et al.

(10) Patent No.: US 9,664,192 B2
(45) Date of Patent: May 30, 2017

(54) ROTARY COMPRESSOR AND REFRIGERATION CYCLE DEVICE

(71) Applicant: Toshiba Carrier Corporation, Kanagawa (JP)

(72) Inventors: Toshimasa Aoki, Fuji (JP); Hisataka Kato, Fuji (JP); Masahiro Hatayama, Fuji (JP); Isao Kawabe, Fuji (JP); Keiichi Hasegawa, Fuji (JP)

(73) Assignee: TOSHIBA CARRIER CORPORATION, Kanagawa (JP)

( * ) Notice: Subject to any disclaimer, the term of this patent is extended or adjusted under 35 U.S.C. 154(b) by 34 days.

(21) Appl. No.: 14/749,128

(22) Filed: Jun. 24, 2015

(65) Prior Publication Data

US 2015/0292506 A1 Oct. 15, 2015

Related U.S. Application Data

(63) Continuation of application No. PCT/JP2013/079430, filed on Oct. 30, 2013.

(30) Foreign Application Priority Data

Mar. 27, 2013 (JP) ..... 2013-066006

(51) Int. Cl.
*F01C 1/344* (2006.01)
*F03C 4/00* (2006.01)
(Continued)

(52) U.S. Cl.
CPC ..... *F04C 18/3568* (2013.01); *F01C 21/0845* (2013.01); *F04C 18/3562* (2013.01);
(Continued)

(58) Field of Classification Search
CPC . F04C 18/356; F04C 18/3564; F04C 18/3568
(Continued)

(56) References Cited

U.S. PATENT DOCUMENTS 6,053,716 A * 4/2000 Riegger ..... F01C 21/0809 418/152
2010/0107669 A1* 5/2010 Wada ..... F16K 11/044 62/196.1

FOREIGN PATENT DOCUMENTS

CN 2479254 Y 2/2002
CN 201021665 Y 2/2008
(Continued)

OTHER PUBLICATIONS

Notification of Transmittal of the International Search Report and the Written Opinion of the International Searching Authority, or the Declaration, including an International Search Report and Written Opinion of the International Searching Authority, mailed Feb. 4, 2014 in connection with PCT International Application No. PCT/JP2013/079430, filed Oct. 30, 2013.
(Continued)

*Primary Examiner* — Deming Wan
(74) *Attorney, Agent, or Firm* — John P. White; Cooper & Dunham LLP

(57) ABSTRACT

In one embodiment, a compression mechanism unit of a rotary compressor includes a cylinder includes a cylinder chamber, a roller in the chamber, first and second vanes which come into contact with the roller and partition the chamber into a compression side and an absorption side, and a bias member which biases the vanes. On both end sides of a posterior end portion of the first vane, first vane side attachment portions having an equal dimension in the axial direction are provided. On both end sides of the second vane along the axial direction of the axis, second vane side attachment portions having an equal dimension in the axial direction are provided. The vanes are attached to the bias member via the attachment portions.

8 Claims, 4 Drawing Sheets

(51) Int. Cl.

| | |
|---|---|
| ***F01C 1/356*** | (2006.01) |
| ***F04C 18/356*** | (2006.01) |
| ***F04C 18/344*** | (2006.01) |
| ***F01C 21/08*** | (2006.01) |
| ***F04C 23/00*** | (2006.01) |
| ***F25B 31/00*** | (2006.01) |
| ***F25B 1/04*** | (2006.01) |

(52) U.S. Cl.
CPC ..... *F04C 18/3564* (2013.01); *F04C 23/001* (2013.01); *F25B 1/04* (2013.01); *F25B 31/00* (2013.01); *F04C 23/008* (2013.01)

(58) Field of Classification Search
USPC ..... 418/248–249, 234, 63, 11, 60
See application file for complete search history.

(56) References Cited

FOREIGN PATENT DOCUMENTS

| | | | |
|---|---|---|---|
| CN | 201891607 | U | 7/2011 |
| CN | 102606481 | A | 7/2012 |
| CN | 202520558 | U | 11/2012 |
| EP | 2372083 | A1 | 10/2011 |
| JP | 105396/1986 | | 1/1988 |
| JP | 1-247786 | | 10/1989 |
| JP | 1999-107955 | A | 4/1999 |
| JP | 2007-187085 | A | 7/2007 |
| JP | 2010-121546 | A | 6/2010 |
| JP | 4488104 | B2 | 6/2010 |
| JP | 5079670 | B2 | 11/2012 |
| WO | WO 2009/093701 | A1 | 7/2009 |

OTHER PUBLICATIONS

Notification of Transmittal of Translation of the International Preliminary Report on Patentability, including the English Translation of the Written Opinion of the International Searching Authority, mailed Oct. 8, 2015 in connection with PCT International Application No. PCT/JP2013/079430, filed Oct. 30, 2013.

May 3, 2016, Chinese official action (including English translation) in connection with corresponding Chinese patent application No. 201380069310.2.

Oct. 5, 2016, European search report in connection with corresponding European patent application No. 13880255.8.

* cited by examiner

ROTARY COMPRESSOR AND REFRIGERATION CYCLE DEVICE

CROSS REFERENCE TO RELATED APPLICATIONS

This application is a Continuation Application of PCT Application No. PCT/JP2013/079430, filed Oct. 30, 2013 and based upon and claiming the benefit of priority from Japanese Patent Application No. 2013-066006, filed Mar. 27, 2013, the entire contents of all of which are incorporated herein by reference.

FIELD

Embodiments described herein relate generally to a rotary compressor, and a refrigeration cycle device comprising the rotary compressor and constituting a refrigeration cycle circuit.

BACKGROUND

Conventionally, there is a refrigeration cycle device comprising a rotary compressor. In this type of rotary compressor, an electric motor as a drive unit is connected to a compression mechanism unit via the rotational axis. The compression mechanism unit comprises a cylinder which forms a cylinder chamber, a roller which eccentrically rotates in the cylinder chamber, and a vane which comes into contact with the roller and partitions the cylinder chamber into a compression side and an absorption side. One vane is used for one roller. The apical end of the vane slidably comes into contact with a roller peripheral wall.

The apical end portion of the vane is abraded as it slidably comes into contact with the roller. To prevent the abrasion of the apical end portion of the vane, a special surface treatment is applied to the portion which slidably comes into contact with the roller in the vane. Thus, the cost tends to be high. In consideration of these factors, the apical end portion of the vane is required to prevent abrasion. In addition, the efficiency in attaching the vane is required to be improved.

CITATION LIST

Patent Literature

Patent Literature 1
Japanese Patent No. 4488104

DETAILED DESCRIPTION

In general, according to one embodiment, a rotary compressor comprises a cylinder, a roller, a first vane, a second vane and a bias member.

The cylinder comprises a cylinder chamber. The roller is housed in the cylinder chamber and eccentrically rotates by rotation of a rotational axis.

The first and second vanes overlap each other in an axial direction of the rotational axis, come into contact with the roller, reciprocate and partition the cylinder chamber into a compression side and an absorption side. The bias member biases the first and second vanes toward the roller.

First vane side attachment portions having an equal dimension in the axial direction are provided on both end sides of a posterior end portion of the first vane along the axial direction. Second vane side attachment portions having an equal dimension in the axial direction are provided on both end sides of a posterior end portion of the second vane along the axial direction. The first and second vanes are attached to the bias member via the first and second vane side attachment portions.

Figure 1:
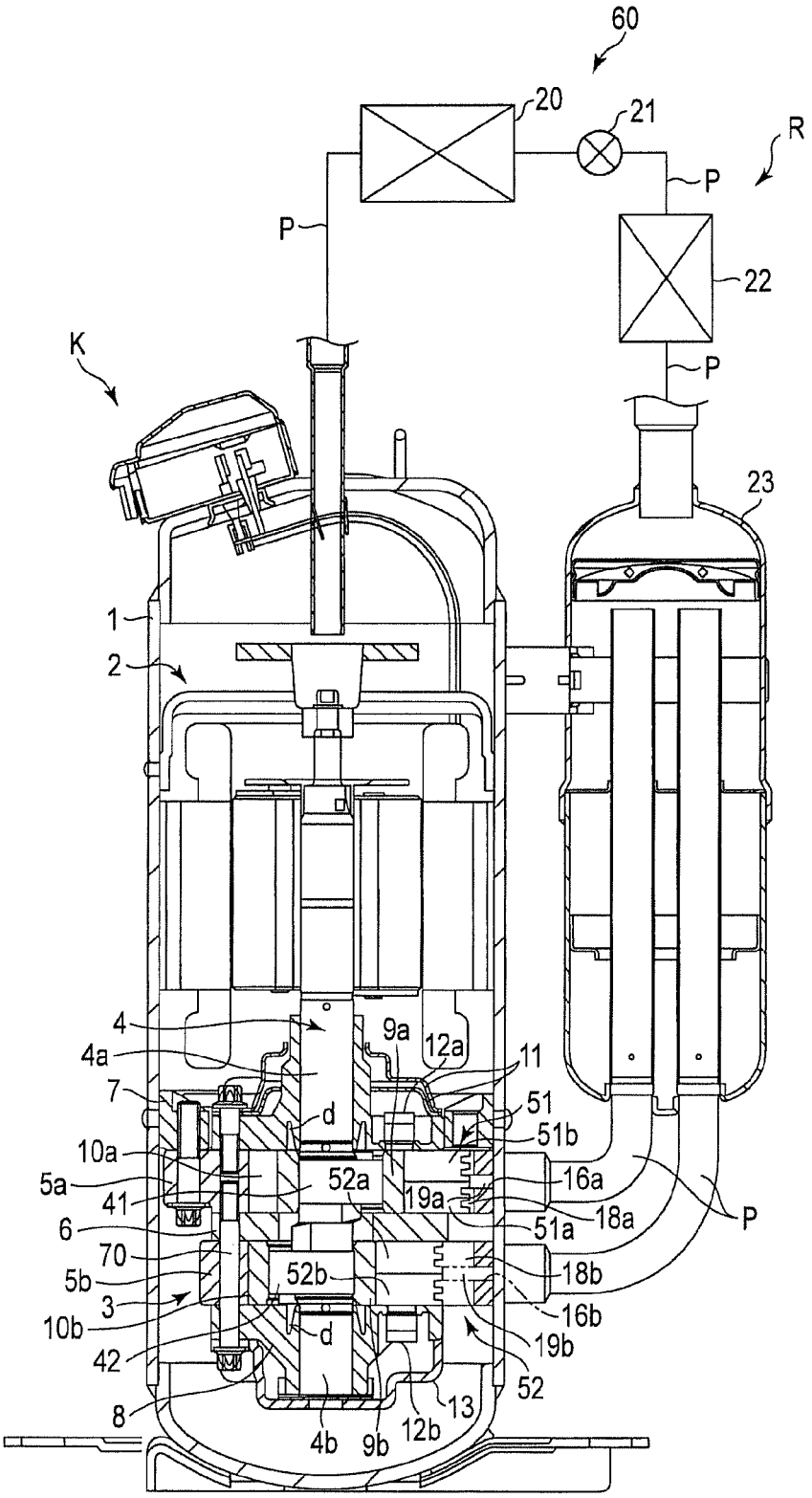
FIG. 1 is a schematic view showing a refrigeration cycle device according to a first embodiment.

A rotary compressor and a refrigeration cycle device according to a first embodiment are explained with reference to FIG. 1 to FIG. 5. FIG. 1 is a schematic view showing a refrigeration cycle device 60. As shown in FIG. 1, the refrigeration cycle device 60 comprises a rotary compressor K, a condenser 20, an expansion device 21, an evaporator 22, an accumulator 23 and a refrigerant pipe P. These devices communicate through the refrigerant pipe P in the described order.

In the present embodiment, a two-cylinder type is shown as an example of the rotary compressor K. In this type, the rotary compressor K comprises two cylinders. FIG. 1 is a cross-sectional view showing the rotary compressor K. The rotary compressor K comprises a sealed case 1, an electric motor unit 2, a compression mechanism unit 3, a rotational axis 4, a main bearing 7 and a sub-bearing 8. The electric motor unit 2, the compression mechanism unit 3, the rotational axis 4, the main bearing 7 and the sub-bearing 8 are housed in the sealed case 1.

The electric motor unit 2 is provided in the upper part of the sealed case 1. The compression mechanism unit 3 is provided in the lower part of the sealed case 1. The lower part of the sealed case 1 is filled with a lubricating oil. The large part of the compression mechanism unit 3 is located in the lubricating oil.

The electric motor unit 2 and the compression mechanism unit 3 are connected to each other via the rotational axis 4. The rotational axis 4 delivers the power generated by the electric motor unit 2 to the compression mechanism unit 3. When the electric motor unit 2 rotationally drives the rotational axis 4, the compression mechanism unit 3 absorbs, compresses and discharges a gaseous refrigerant as described below.

The compression mechanism unit 3 comprises a first cylinder 5*a* in the upper part and a second cylinder 5*b* in the lower part. An intermediate partition plate 6 is interposed between the first cylinder 5*a* and the second cylinder 5*b*.

The main bearing 7 overlaps the upper surface of the first cylinder 5*a*. The main bearing 7 is attached to the inner peripheral wall of the sealed case 1. The sub-bearing 8 overlaps the lower surface of the second cylinder 5*b*. The sub-bearing 8 is secured to the first cylinder 5*a* by a bolt 70 together with the second cylinder 5*b* and the intermediate partition plate 6.

A main axis portion 4*a* of the rotational axis 4 is pivotably and rotatably supported by the main bearing 7. A sub-axis portion 4*b* of the rotational axis 4 is pivotably and rotatably supported by the sub-bearing 8. The rotational axis 4 penetrates the first cylinder 5*a*, the intermediate partition plate 6 and the second cylinder 5*b*.

The rotational axis 4 comprises a first eccentric portion 41 and a second eccentric portion 42. The first eccentric portion 41 is housed in a first cylinder chamber 10*a* of the first cylinder 5*a*. The second eccentric portion 42 is housed in a second cylinder chamber 10*b* of the second cylinder 5*b*. The first eccentric portion 41 and the second eccentric portion 42 have the same diameter and a phase difference of substantially 180° and are positioned out of alignment with each other.

A first roller 9*a* fits in the peripheral wall of the first eccentric portion 41 and is housed in the first cylinder chamber 10*a* of the first cylinder 5*a*. A second roller 9*b* fits in the peripheral wall of the second eccentric portion 42 and is housed in the second cylinder 5*b*. In association with rotation of the rotational axis 4, the first and second rollers 9*a* and 9*b* eccentrically rotate while their peripheral walls partially come into contact with the peripheral walls of the first cylinder chamber 10*a* and the second cylinder chamber 10*b*, respectively.

The first cylinder chamber 10*a* is a space inside the first cylinder 5*a*. The first cylinder chamber 10*a* is blocked by the main bearing 7 and the intermediate partition plate 6, and thus, the first cylinder chamber 10*a* is formed. The second cylinder chamber 10*b* is a space inside the second cylinder 5*b*. The second cylinder chamber 10*b* is blocked by the intermediate partition plate 6 and the sub-bearing 8, and thus, the second cylinder chamber 10*b* is formed.

The diameter and the height of the first cylinder chamber 10*a* are set so as to be equal to those of the second cylinder chamber 10*b*. The heights are the lengths along the axial direction of the rotational axis 4. The first roller 9*a* is housed in the first cylinder chamber 10*a*. The second roller 9*b* is housed in the second cylinder chamber 10*b*.

A pair of discharge mufflers 11 is attached to the main bearing 7. The pair of discharge mufflers 11 overlaps doubly. A discharge hole is provided in each discharge muffler 11. Discharge mufflers 11 cover a discharge valve mechanism 12*a* provided in the main bearing 7. A discharge muffler 13 is attached to the sub-bearing 8. Discharge muffler 13 covers a discharge valve mechanism 12*b* provided in the sub-bearing 8. No discharge hole is provided in discharge muffler 13.

Discharge valve mechanism 12*a* of the main bearing 7 communicates with the first cylinder chamber 10*a*. When the pressure in the first cylinder chamber 10*a* has reached a predetermined pressure after increase in association with a compression influence, discharge valve mechanism 12*a* opens and discharges the compressed gaseous refrigerant into discharge mufflers 11. Discharge valve mechanism 12*b* of the sub-bearing 8 communicates with the second cylinder chamber 10*b*. When the pressure in the second cylinder chamber 10*b* has reached a predetermined pressure after increase in association with a compression influence, discharge valve mechanism 12*b* opens and discharges the compressed gaseous refrigerant into discharge muffler 13.

A discharge gas guide path is provided over the sub-bearing 8, the second cylinder 5*b*, the intermediate partition plate 6, the first cylinder 5*a* and the main bearing 7. The gaseous refrigerant discharged to discharge muffler 13 is guided into the double discharge mufflers 11 in the upper part through the above discharge gas guide path, is mixed with the gaseous refrigerant discharged through discharge valve mechanism 12*a* and is discharged into the sealed case.

A first vane unit 51 is provided in the first cylinder 5*a*. The first vane unit 51 comprises a first vane 51*a* and a second vane 51*b*. The first vane 51*a* and the second vane 51*b* overlap each other along the height direction of the first cylinder 5*a*; in other words, along the axial direction of the rotational axis 4. The second vane 51*b* is provided on the main bearing 7 side relative to the first vane 51*a*.

The posterior end portions of the first and second vanes 51*a* and 51*b* come into contact with an end portion of a coil spring 16*a* which is a bias member as described later. Coil spring 16*a* biases the first and second vanes 51*a* and 51*b* toward the first roller 9*a* such that the apical end portions of the first and second vanes 51*a* and 51*b* come into contact with the outer peripheral surface of the first roller 9*a*. The attachment structure of coil spring 16*a* relative to the first and second vanes 51*a* and 51*b* is explained in detail later.

A vane groove 17*a* which opens in the first cylinder chamber 10*a* is provided in the first cylinder 5*a*. Further, the first cylinder 5*a* comprises a vane back chamber 18*a* in the posterior end portion of vane groove 17*a*.

In vane groove 17*a*, the first and second vanes 51*a* and 51*b* are housed such that they overlap each other in the height direction of the first cylinder 5*a* and can freely reciprocate. The apical end portions of the first and second vanes 51*a* and 51*b* are capable of freely protruding and receding relative to the first cylinder chamber 10*a*. The posterior end portions are capable of freely protruding and receding relative to vane back chamber 18*a*.

Vane back chamber 18*a* opens in the sealed case 1. Thus, the posterior ends of the first and second vanes 51*a* and 51*b* are influenced by the pressure in the sealed case 1.

The apical end portions of the first and second vanes 51*a* and 51*b* are formed in a substantially arc shape in a planar view. Regardless of the rotation angle of the first roller 9*a*, these apical end portions come into line contact with the peripheral wall of the first roller 9*a* having a circular shape in a planar view in a state where the apical end portions protrude to the first cylinder chamber 10*a*.

Further, a spring housing hole 19*a* is provided on the outer peripheral wall of the first cylinder 5*a*. Spring housing hole 19*a* is provided to the extent of the first cylinder chamber 10*a* side via vane back chamber 18.

Coil spring 16*a* is housed in spring housing hole 19*a*. When coil spring 16*a* is composed as the compression mechanism unit 3, an end portion of coil spring 16*a* comes into contact with the inner peripheral wall of the sealed case 1. The other end portion of coil spring 16*a* comes into contact with both the first and second vanes 51*a* and 51*b* overlapping each other in the axial direction, and biases the first and second vanes 51*a* and 51*b* toward the first roller 9*a*.

A second vane unit 52 is provided in the second cylinder 5*b*. The second vane unit 52 comprises a first vane 52*a* and a second vane 52*b*. The first vane 52*a* and the second vane 52*b* overlap each other in the height direction of the second cylinder 5*b*; in other words, in the axial direction of the rotational axis 4. The second vane 52*b* is provided on the sub-bearing 8 side relative to the first vane 52*a*.

The posterior portions of the first and second vanes 52*a* and 52*b* come into contact with an end portion of a coil spring 16*b* which is a bias member as described later. Coil spring 16*b* biases the first and second vanes 52*a* and 52*b* toward the second roller 9*b* such that the apical end portions of the first and second vanes 52*a* and 52*b* come into contact with the outer peripheral surface of the second roller 9*b*. The attachment structure of coil spring 16*b* relative to the first and second vanes 52*a* and 52*b* is explained in detail later.

A vane groove 17*b* which opens in the second cylinder chamber 10*b* is provided in the second cylinder 5*b*. Further, the second cylinder 5*b* comprises a vane back chamber 18*b* in the posterior end portion of vane groove 17*b*.

In vane groove 17*b*, the first and second vanes 52*a* and 52*b* are housed such that they overlap each other in the height direction of the second cylinder 5*b* and can freely reciprocate. The apical end portions of the first and second vanes 52*a* and 52*b* are capable of freely protruding and receding relative to the second cylinder chamber 10*b*. The posterior end portions are capable of freely protruding and receding relative to vane back chamber 18*b*.

Vane back chamber 18*b* opens in the sealed case 1. Thus, the posterior ends of the first and second vanes 52*a* and 52*b* are influenced by the pressure in the sealed case 1.

The apical end portions of the first and second vanes 52*a* and 52*b* are formed in a substantially arc shape in a planar view. Regardless of the rotation angle of the second roller 9*b*, these apical end portions come into line contact with the peripheral wall of the second roller 9*b* having a circular shape in a planar view in a state where the apical end portions protrude to the second cylinder chamber 10*b*.

Further, a spring housing hole 19*b* is provided on the outer peripheral wall of the second cylinder 5*b*. Spring housing hole 19*b* is provided to the extent of the second cylinder chamber 10*b* side via vane back chamber 18*b*.

Coil spring 16*b* is housed in spring housing hole 19*b*. When coil spring 16*b* is composed as the compression mechanism unit 3, an end portion of coil spring 16*b* comes into contact with the inner peripheral wall of the sealed case 1. The other end portion of coil spring 16*b* comes into contact with both the first and second vanes 52*a* and 52*b*, and biases the first and second vanes 52*a* and 52*b* toward the second roller 9*b*.

If the pressure in the sealed case 1 is low and is not enough to press the first and second vanes 51*a* and 51*b* onto the first roller 9*a* at the time of activation, coil spring 16*a* biases the first and second vanes 51*a* and 51*b* toward the first roller 9*a*. This mechanism is also applied to coil spring 16*b*.

The refrigerant pipe P for discharge is connected to the upper end portion of the sealed case 1. The condenser 20, the expansion device 21, the evaporator 22 and the accumulator 23 are provided in the refrigerant pipe P such that the devices communicate in series.

Two refrigerant pipes P for absorption extend from the accumulator 23 and are connected to the first cylinder chamber 10*a* and the second cylinder chamber 10*b* via the sealed case 1 of the rotary compressor K. In this manner, a refrigeration cycle circuit R of the refrigeration cycle device is structured.

Figure 2:
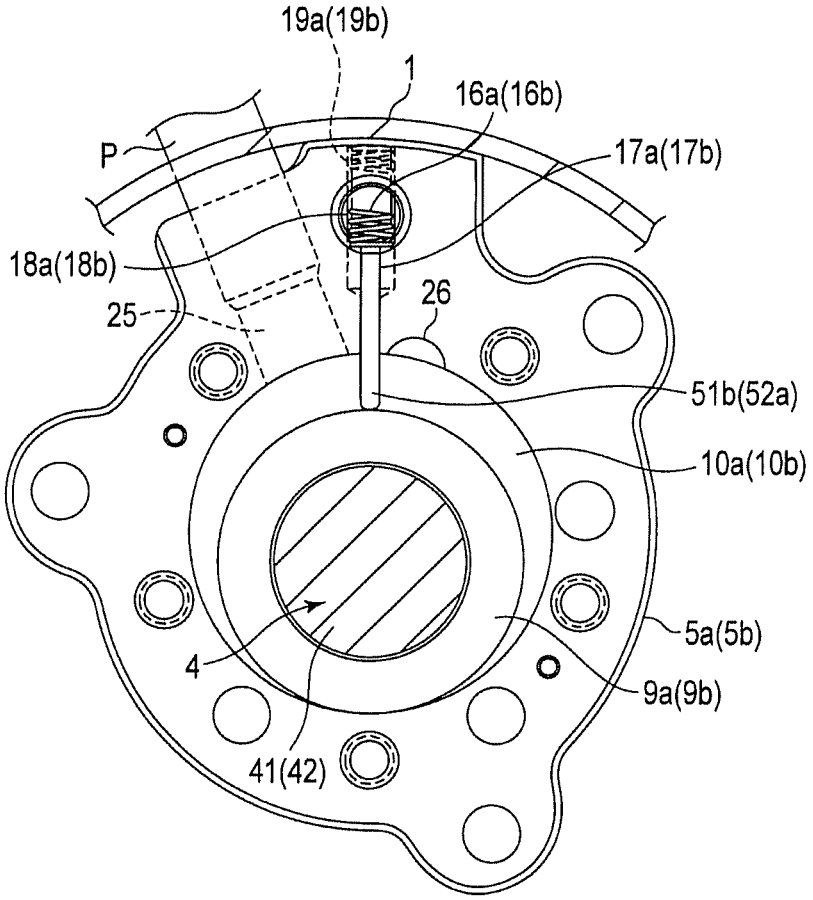
FIG. 2 is a plan view showing a first cylinder chamber of a rotary compressor and its vicinity according to the first embodiment.

FIG. 2 is a plan view showing the first cylinder chamber 10*a* and its vicinity. The planar shape of the second cylinder chamber 10*b* and its vicinity is the same as that of the first cylinder chamber 10*a* and its vicinity shown in FIG. 2. In FIG. 2, the reference numbers of the second cylinder chamber 10*b* and the structures provided in its vicinity are put in parentheses and described beside the reference numbers of the first cylinder chamber 10*a* and the structures provided in its vicinity. In the following description, FIG. 2 is also used to explain the second cylinder chamber 10*b* and the structures provided in its vicinity.

As shown in FIG. 2, an absorption hole 25 is provided from the sealed case 1 and the outer peripheral wall of the first cylinder 5*a* to the first cylinder chamber 10*a*. In a similar manner, the absorption hole 25 is provided from the sealed case 1 and the outer peripheral wall of the second cylinder 5*b* to the second cylinder chamber 10*b*.

The refrigerant pipes P for absorption diverge from the accumulator 23 and are inserted into and secured to the above absorption holes 25. In the first and second cylinders 5*a* and 5*b*, the absorption holes are provided on one side of the circumferential direction of the first and second cylinders 5*a* and 5*b* with the first and second vane units 51 and 52 and grooves 17*a* and 17*b* being interposed. A discharge notch 26 which communicates with a discharge valve mechanism 12 is provided on the other side of the circumferential direction.

In the rotary compressor K having the above structure, when the rotational axis 4 is rotationally driven in association with power distribution to the electric motor unit 2, the posterior ends of the first and second vanes 51*a* and 51*b* are influenced by the pressure in the sealed case 1 and the bias force of coil spring 16*a* in the first cylinder chamber 10*a*. By the bias force, the first and second vanes 51*a* and 51*b* elastically come into contact with the peripheral wall of the first roller 9*a*. In this manner, the first roller 9*a* eccentrically rotates.

In a similar manner, in the second cylinder chamber 10*b*, the posterior ends of the first and second vanes 52*a* and 52*b* are influenced by the pressure in the sealed case 1 and the bias force of coil spring 16*b*. By the bias force, the first and second vanes 52*a* and 52*b* elastically come into contact with the peripheral wall of the second roller 9*b*. In this manner, the second roller 9*b* eccentrically rotates.

In association with the eccentric rotation of the first and second rollers 9*a* and 9*b*, a gaseous refrigerant is absorbed from the refrigerant pipes P for absorption to the absorption side of the first and second cylinder chambers 10*a* and 10*b* partitioned by the first and second vane units 51 and 52. Moreover, the gaseous refrigerant is moved to the compression side of the first and second cylinder chambers 10*a* and 10*b* partitioned by the first and second vane units 51 and 52 and is compressed. When the pressure of the gaseous refrigerant is increased to a predetermined pressure in association with decrease in the volume on the compression side, the discharge valve mechanism 12 opens, and the gaseous refrigerant is discharged from the discharge hole 26.

The gaseous refrigerant discharged from the first cylinder chamber 10*a* and the gaseous refrigerant discharged from the second cylinder chamber 10*b* join in two discharge mufflers 11 overlapping each other in the upper part. The joined gaseous refrigerant is discharged into the sealed case 1. The gaseous refrigerant discharged into the sealed case 1 fills the upper end portion of the sealed case 1 through the gas guide path provided among the components of the electric motor unit 2, and is discharged from the refrigerant pipe P to the outside of the rotary compressor K. The pressure of the compressed gaseous refrigerant affects the posterior ends of the first and second vanes 51*a* and 51*b* of the first vane unit 51 and the posterior ends of the first and second vanes 52*a* and 52*b* of the second vane unit 52.

The gaseous refrigerant having a high pressure is guided to and condensed in the condenser 20 and is changed to a liquid refrigerant. The liquid refrigerant is guided to and adiabatically expanded in the expansion device 21, and is guided to and evaporates in the evaporator 22. In this manner, the liquid refrigerant is changed to a gaseous refrigerant. A refrigeration effect is exerted by absorbing evaporative latent heat from the surrounding air in the evaporator 22.

If the rotary compressor K is mounted on an air conditioner, a cooling effect is exerted. Furthermore, a heat pump refrigeration cycle circuit may be structured by providing a four-way switching valve on the discharge side of the rotary compressor K in the refrigeration cycle. This refrigeration cycle exerts a heating effect if the flow of the refrigerant is switched to the opposite direction by the four-way switching valve such that the gaseous refrigerant discharged from the rotary compressor K is directly guided to an indoor heat exchanger.

As the pressure in the sealed case 1 is increased by operation of the rotary compressor K, the pressure (back pressure) applied to the posterior end portions of the first and second vanes 51*a* and 51*b* is increased, and the pushing force relative to the first roller 9*a* is increased. In a similar manner, the pushing force of the first and second vanes 52*a* and 52*b* relative to the second roller 9*b* is increased.

Now, the details of the first and second vanes 51*a* and 51*b* of the first vane unit 51, the first and second vanes 52*a* and 52*b* of the second vane unit 52, the attachment structure of coil spring 16*a* relative to the first and second vanes 51*a* and 51*b* and the attachment structure of coil spring 16*b* relative to the first and second vanes 52*a* and 52*b* are explained.

Figure 3:
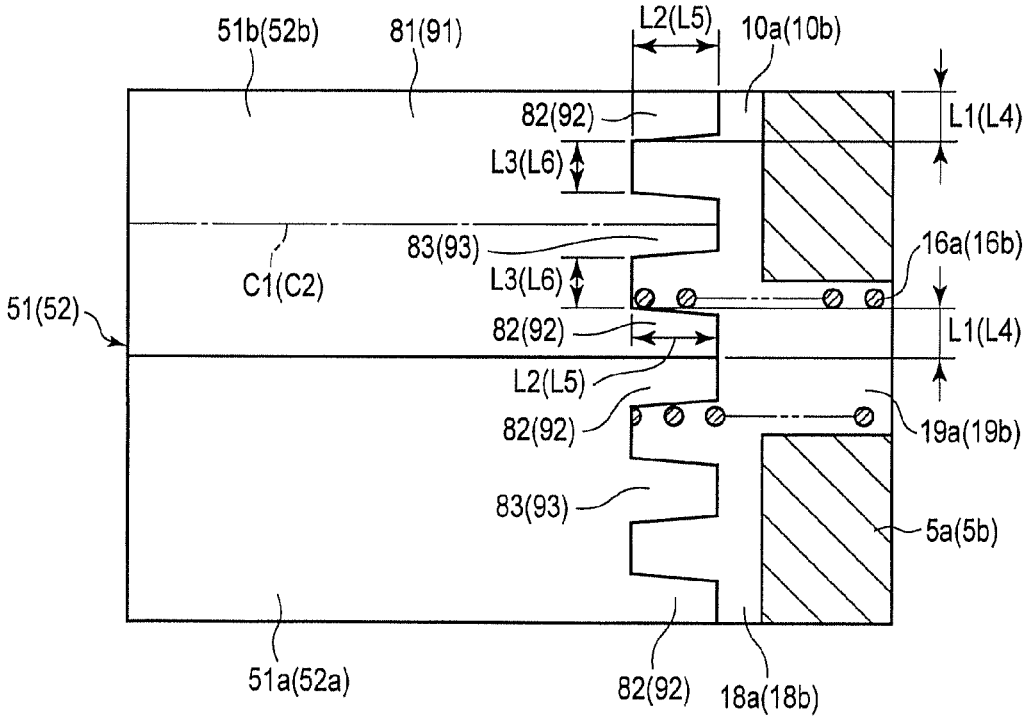
FIG. 3 is a cross-sectional view showing the main part of a first cylinder according to the first embodiment.

First, the first and second vanes 51*a* and 51*b* of the first vane unit 51 are explained. FIG. 3 is a cross-sectional view of the main part of the first cylinder 5*a*. As shown in FIG. 3, the first vane 51*a* has the same shape as the second vane 51*b*. Here, the second vane 51*b* is explained as the representative. The second vane 51*b* comprises a main body portion 81, an attachment protrusion portion 82 which is a second vane side attachment portion, and a positional shift prevention protrusion portion 83.

The main body portion 81 is a portion comprising the apical end portion which comes into contact with the first roller 9*a* in the second vane 51*b*. The attachment protrusion portion 82 is provided at the posterior end of the main body portion 81 and protrudes from the posterior end of the main body portion 81 to the vane back chamber 18*a* side.

The attachment protrusion portion 82 is provided on each end side along the axial direction of the rotational axis 4 at the posterior end of the main body portion 81. Both of the attachment protrusion portions 82 have the same shape. Thus, length L1 of one attachment protrusion portion 82 along the axial direction of the rotational axis 4 is equal to length L1 of the other attachment protrusion portion 82 along the axial direction of the rotational axis 4. In the attachment protrusion portions 82, lengths L2 along the movement direction of the first vane 51*b* are equal to each other. Therefore, there is no problem even if the second vane 51*b* is turned upside down at the time of incorporation. The second vane 51*b* can be incorporated regardless of the vertical orientation.

The positional shift prevention protrusion portion 83 is provided in the center at the posterior end of the second vane 51*b* in the axial direction of the rotational axis 4. Length L3 between one attachment protrusion portion 82 and the positional shift prevention protrusion portion 83 is equal to length L3 between the other attachment protrusion portion 82 and the positional shift prevention protrusion portion 83.

Thus, the shapes of both of the attachment protrusion portions 82 are the same as each other. In addition, the distance (L3) between one attachment protrusion portion 82 and the positional shift prevention protrusion portion 83 is equal to the distance (L3) between the other attachment protrusion portion 82 and the positional shift prevention protrusion portion 83. This structure allows the second vane 51*b* to be symmetrical about central line C1 in the axial direction of the rotational axis 4.

The first vane 51*a* has the same shape as the second vane 51*b*. In a manner similar to that of the second vane 51*b*, the first vane 51*a* comprises the main body portion 81, the attachment protrusion portion 82 which is a first vane side attachment portion, and the positional shift prevention protrusion portion 83. Therefore, there is no problem even if the first vane 51*a* is turned upside down at the time of incorporation. The first vane 51*a* can be incorporated regardless of the vertical orientation.

Now, length L1 of each attachment protrusion portion is explained in detail. As shown in FIG. 3, when the first and second vanes 51*a* and 51*b* are housed in the first cylinder 5*a* and overlap each other in the axial direction of the rotational axis 4, one attachment protrusion portion 82 of the first vane 51*a* overlaps one attachment protrusion portion 82 of the second vane 51*b*. These overlapped attachment protrusion portions 82 of the first and second vanes 51*a* and 51*b* fit into coil spring 16*a*. This structure enables one end portion of coil spring 16*a* to be attached to the first and second vanes 51*a* and 51*b*. Length L1 of each attachment protrusion portion 82 is set such that, when two attachment protrusion portions 82 overlap each other as shown in FIG. 3, the two attachment protrusion portions 82 are secured to the inner side of coil spring 16*a*. When two attachment protrusion portions 82 are arranged side by side, they are configured to secure one end portion of coil spring 16*a*.

The first and second vanes 51*a* and 51*b* have the same shape. This structure enables coil spring 16*a* to be secured to the side-by-side attachment protrusion portions 82 of the first vane 51*a* and the second vane 51*b* even if the first and second vanes 51*a* and 51*b* are attached to the first cylinder chamber 10*a* incorrectly such that the position of the first vane 51*a* is replaced by that of the second vane 51*b*; in other words, even if the second vane 51*b* is provided in the position of the first vane 51*a* shown in FIG. 3, and further, the first vane 51*a* is provided in the position of the second vane 51*b* shown in FIG. 3.

Now, the first and second vanes 52*a* and 52*b* of the second vane unit 52 are explained. In the present embodiment, the second vane unit 52 has the same structure as the first vane unit 51. Thus, FIG. 3 is used to explain the second vane unit 52. In FIG. 3, the reference numbers indicating the structures of the second vane unit 52 are put in parentheses beside the reference numbers of the corresponding structures of the first vane unit 51.

FIG. 3 is a cross-sectional view showing the inner side of the second cylinder chamber 10*b* of the second cylinder 5*b*. As shown in FIG. 3, the first and second vanes 52*a* and 52*b* have the same shape. Here, the second vane 52*b* is explained as the representative. The second vane 52*b* comprises a main body portion 91, an attachment protrusion portion 92 which is a second vane side attachment portion, and a positional shift prevention protrusion portion 93.

The main body portion 91 is a portion comprising the apical end portion which comes into contact with the second roller 9*b* in the second vane 52*b*. The attachment protrusion portion 92 is provided at the posterior end of the main body portion 91 and protrudes from the posterior end of the main body portion 91 to vane back chamber 18*b*.

The attachment protrusion portion 92 is provided in each end portion along the axial direction of the rotational axis 4 at the posterior end of the main body portion 91. Both of the attachment protrusion portions 92 have the same shape. Thus, length L4 of one attachment protrusion portion 92 along the axial direction of the rotational axis 4 is equal to length L4 of the other attachment protrusion portion 92 along the axial direction of the rotational axis 4. In the attachment protrusion portions 92, lengths L5 along the movement direction of the second vane 52*b* are equal to each other. Therefore, the second vane 52*b* can be incorporated regardless of the vertical orientation.

The positional shift prevention protrusion portion 93 is provided in the center at the posterior end of the first vane 52*a* in the axial direction of the rotational axis 4. Length L6 between one attachment protrusion portion 92 and the positional shift prevention protrusion portion 93 is equal to length L6 between the other attachment protrusion portion 92 and the positional shift prevention protrusion portion 93.

Thus, the shapes of the attachment protrusion portions 92 are the same as each other. In addition, the distance (L6) between one attachment protrusion portion 92 and the positional shift prevention protrusion portion 93 is equal to the distance (L6) between the other attachment protrusion portion 92 and the positional shift prevention protrusion portion 93. This structure allows the second vane 52*b* to be symmetrical about central line C2 in the axial direction of the rotational axis 4.

The first vane 52*a* has the same shape as the second vane 52*b*. In a manner similar to that of the second vane 52*b*, the first vane 52*a* comprises the main body portion 91, the attachment protrusion portion 92 and the positional shift prevention protrusion portion 93 which is a first vane side attachment portion. Therefore, the first vane 52*a* can be incorporated regardless of the vertical orientation.

Now, length L4 of each attachment protrusion portion is explained in detail. As shown in FIG. 3, when the first and second vanes 52*a* and 52*b* are housed in the second cylinder 5*b* and overlap each other in the axial direction of the rotational axis 4, one attachment protrusion portion 92 of the first vane 52*a* overlaps one attachment protrusion portion 92 of the second vane 52*b*. These overlapped attachment protrusion portions 92 of the first and second vanes 52*a* and 52*b* fit into coil spring 16*b*. This structure enables one end portion of coil spring 16*b* to be attached to the first and second vanes 52*a* and 52*b*. Length L4 of each attachment protrusion portion 92 is set such that, when two attachment protrusion portions 92 overlap each other as shown in FIG. 3, the two attachment protrusion portions 92 are secured to the inner side of coil spring 16*b*. When two attachment protrusion portions 92 are arranged side by side, they are configured to secure one end portion of coil spring 16*b*.

Coil spring 16*b* is provided between the attachment protrusion portion 92 and the positional shift prevention protrusion portion 93. The positional shift prevention protrusion portion 93 come into contact with coil spring 16*b* in order to prevent positional shift of coil spring 16*b* relative to the attachment protrusion portion 92.

The first and second vanes 52*a* and 52*b* have the same shape. This structure enables coil spring 16*b* to be secured to the side-by-side attachment protrusion portions 92 of the first vane 52*a* and the second vane 52*b* even if the first and second vanes 52*a* and 52*b* are attached to the second cylinder chamber 10*b* incorrectly such that the position of the first vane 52*a* is replaced by that of the second vane 52*b*; in other words, even if the second vane 52*b* is provided in the position of the first vane 52*a* shown in FIG. 3, and further, the first vane 52*a* is provided in the position of the second vane 52*b* shown in FIG. 3.

In the rotary compressor K having the above structure, the first vane unit 51 comprises the first and second vanes 51*a* and 51*b*. In other words, the first vane unit 51 has a structure in which a vane is divided into two vanes. Thus, in the first and second vanes 51*a* and 51*b*, it is possible to prevent partial development of abrasion of the portion which comes into contact with the first roller 9*a*.

By dividing a vane into two vanes, the area of the posterior end portion affected by the pressure in the sealed case is halved in the two vanes (the first and second vanes 51*a* and 51*b*). Thus, the pushing force applied onto the first roller 9*a* is also halved compared with a structure in which the number of vanes is one. Thus, abrasion can be prevented by decreasing the contact pressure of the apical end portions of the first and second vanes 51*a* and 51*b*. In particular, even if the rotational axis is bended by, for example, compression load, and the outer circumferential surface of the roller partially comes into contact with the apical end portion of the blade, and thus, partial contact occurs, it is possible to decrease a local contact pressure and prevent abrasion.

Moreover, all of lengths L1 of the attachment protrusion portions 82 formed in both end portions of the first and second vanes 51*a* and 51*b* are set so as to be equal to each other. This structure enables spring 16*a* to be secured to the first and second vanes 51*a* and 51*b* even if the attachment positions of the first and second vanes 51*a* and 51*b* are replaced by each other. There is no problem even if the first and second vanes 51*a* and 51*b* are attached incorrectly such that their positions are replaced by each other. Thus, the attachment operation is not conducted again.

In the present embodiment, it is possible to prevent development of abrasion of the vanes provided in the first cylinder chamber. In addition, even if the first and second vanes 51*a* and 51*b* are attached incorrectly such that their positions are replaced by each other, the attachment operation is not conducted again. Thus, the efficiency in the attachment operation can be improved.

Each of the first and second vanes 51*a* and 51*b* is symmetrical about central line C1 in the axial direction. Thus, it is possible to improve the efficiency in manufacturing the first and second vanes 51*a* and 51*b*. Now, this point is explained in detail.

Each of the first and second vanes 51*a* and 51*b* is symmetrical about central line C1 in the axial direction. Thus, the attachment protrusion portions 82 provided in both end portions of each of the first and second vanes 51*a* and 51*b* can be manufactured by the same process. For example, when the attachment protrusion portions 82 are formed by a cutting process, the cutting process can be the same process. In this manner, it is possible to improve the efficiency in manufacturing the first and second vanes 51*a* and 51*b*.

Since the first and second vanes 51*a* and 51*b* have the same shape, the manufacturing efficiency can be further improved.

Figure 4:
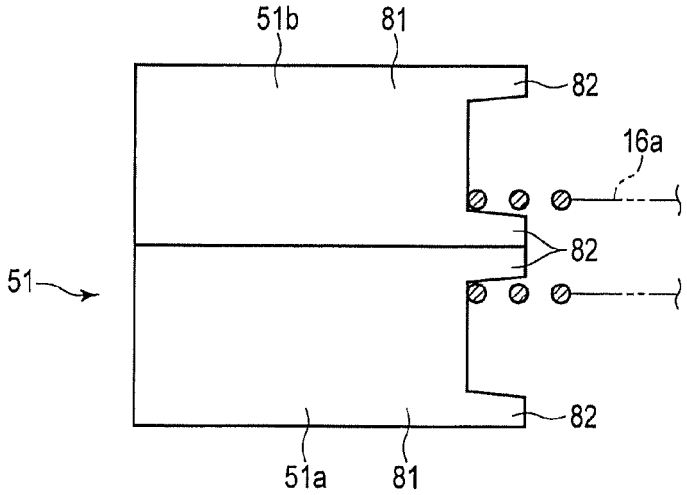
FIG. 4 is a side view showing modification examples of first and second vanes of the rotary compressor.
Figure 5:
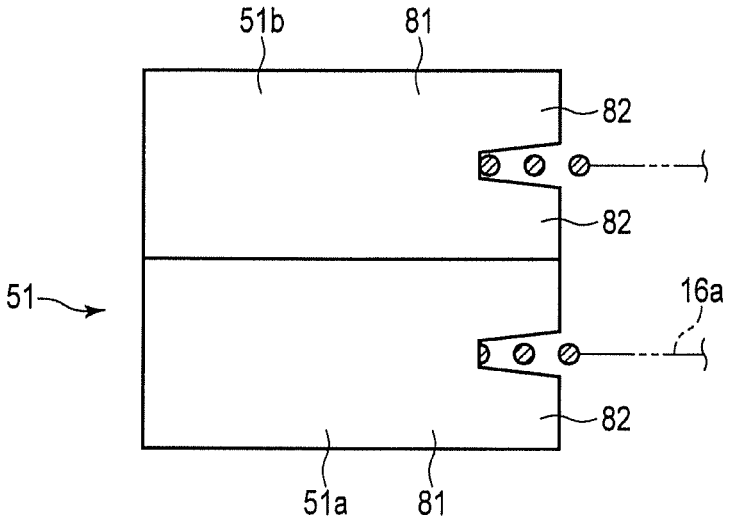
FIG. 5 is a side view showing modification examples of the first and second vanes of the rotary compressor.

The above effects in the first vane unit 51 are also applicable to the second vane unit 52. FIG. 4 and FIG. 5 show other shapes of the first and second vanes 51*a* and 51*b*. As shown in FIG. 4 and FIG. 5, similar effects can be obtained even if no positional shift prevention protrusion portion 83 is provided. This explanation is also applicable to the second vanes 52*a* and 52*b*.

Now, a rotary compressor and a refrigeration cycle device according to a second embodiment are explained with reference to FIG. 6. The structures having the functions identical to those of the first embodiment are denoted by the same reference numbers as the first embodiment. Thus, the explanation of such structures is omitted. In the present embodiment, the shapes of first and second vanes in first and second vane portions are different from those of the first embodiment. The other structures are the same as those of the first embodiment. The above different structures are explained in detail below.

Figure 6:
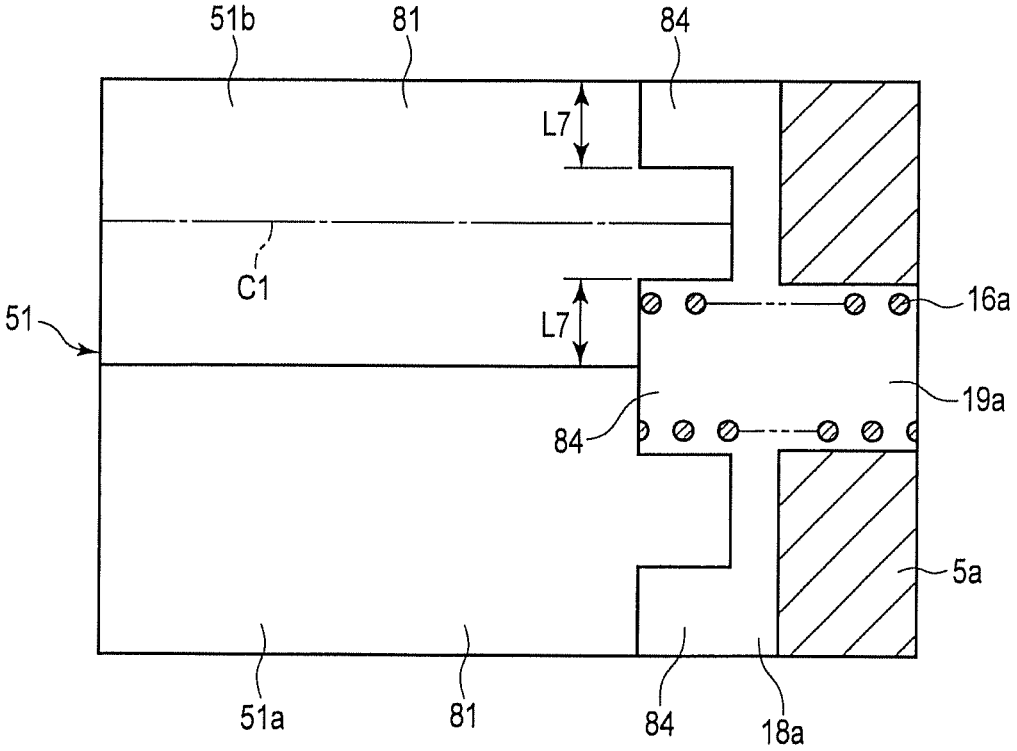
FIG. 6 is a cross-sectional view showing the inner side of a first cylinder chamber of a rotary compressor of a refrigeration cycle device according to a second embodiment.

FIG. 6 is a cross-sectional view showing the inner side of a first cylinder chamber 10*a* according to the present embodiment. As shown in FIG. 6, in the present embodiment, first and second vanes 51*a* and 51*b* comprise attachment recess portions 84 as first vane side attachment portions and second vane side attachment portions. The attachment recess portions 84 are provided on both end sides of the posterior end portion of each of the first and second vanes 51*a* and 51*b* along the axial direction of the rotational axis. Thus, in each of the first and second vanes 51*a* and 51*b*, the portion between the both attachment recess portions 84 protrudes. Lengths L7 of the attachment recess portions 84 provided on both end sides along the axial direction of a rotational axis 4 are equal to each other in each of the first and second vanes 51*a* and 51*b*. Therefore, there is no problem even if each of the first and second vanes 51*a* and 51*b* is turned upside down. Each of the first and second vanes 51*a* and 51*b* can be incorporated regardless of the vertical orientation. Even if the first vane 51*a* and the second vane 51*b* are incorporated such that they are replaced by each other, this structure does not entail any trouble.

Length L7 of each attachment recess portion 84 along the axial direction of the rotational axis 4 is set such that, when the first and second vanes 51*a* and 51*b* overlap each other as shown in FIG. 6, a coil spring 16*a* fits into the recess portion formed by combination of the attachment recess portions 84 of the first and second vanes 51*a* and 51*b*.

In the present embodiment, the first vane 51*a* is symmetrical about central line C1 in the axial direction of the rotational axis. The second vane 51*b* has the same shape as the first vane 51*a*.

In the present embodiment, lengths L7 of the attachment recess portions 84 provided at both ends of each of the first and second vanes 51*a* and 51*b* are equal to each other. Thus, effects similar to those of the first embodiment can be obtained.

In the present embodiment, the first and second vanes 51*a* and 51*b* are explained. In a similar manner, first and second vanes 52*a* and 52*b* may comprise attachment recess portions.

In the above embodiments, it is possible to improve the efficiency in attaching the vanes while preventing local abrasion of the apical end portions of the vanes.

The attachment protrusion portions 82 and 92 formed in the first vanes 51*a* and 52*a* are examples of the first vane side attachment portions. The attachment protrusion portions 82 and 92 formed in the second vanes 51*b* and 52*b* are examples of the second vane side attachment portions. The attachment recess portions 84 formed in the first vane 51*a* are examples of the first vane side attachment portions. The attachment recess portions 84 formed in the second vane 51*b* are examples of the second vane side attachment portions.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A rotary compressor comprising:

a cylinder comprising a cylinder chamber;

a roller which is housed in the cylinder chamber and eccentrically rotates by rotation of a rotational axis;

a first vane and a second vane which come into contact with the roller, reciprocate, partition the cylinder chamber into a compression side and an absorption side and overlap each other in an axial direction of the rotational axis; and a coil spring which biases the first and second vanes toward the roller, wherein first protrusion portions having an equal length in the axial direction are provided on both end sides of a posterior end portion of the first vane along the axial direction, second protrusion portions having an equal length in the axial direction are provided on both end sides of a posterior end portion of the second vane along the axial direction, the first protrusion portions and the second protrusion portions protrude to the coil spring side, and the first and second vanes are attached to the coil spring by overlapping the first protrusion portion of the first vane in an end portion on the second vane side in the axial direction with the second protrusion portion of the second vane in an end portion on the first vane side in the axial direction and fitting the overlapped protrusion portions into the coil spring.

2. The rotary compressor of claim 1, wherein each of the first and second vanes is symmetrical about a central line in the axial direction.

3. The rotary compressor of claim 1, wherein the first vane has a same shape as the second vane.

4. A rotary compressor comprising:

a cylinder comprising a cylinder chamber;

a roller which is housed in the cylinder chamber and eccentrically rotates by rotation of a rotational axis;

a first vane and a second vane which come into contact with the roller, reciprocate, partition the cylinder chamber into a compression side and an absorption side and overlap each other in an axial direction of the rotational axis; and a coil spring which biases the first and second vanes toward the roller, wherein first recess portions having an equal length in the axial direction are provided on both end sides of a posterior end portion of the first vane along the axial direction, second recess portions having an equal length in the axial direction are provided on both end sides of a posterior end portion of the second vane along the axial direction, the first recess portions and the second recess portions are hollowed toward the roller, and the first and second vanes are attached to the coil spring by fitting the coil spring into a recess portion formed by combination between the first recess portion of the first vane in an end portion on the second vane side in the axial direction and the second recess portion of the second vane in an end portion on the first vane side in the axial direction.

5. The rotary compressor of claim 4, wherein each of the first and second vanes is symmetrical about a central line in the axial direction.

6. The rotary compressor of claim 4, wherein the first vane has a same shape as the second vane.

7. A refrigeration cycle device comprising:

a rotary compressor;

a condenser;

an expansion device;

an evaporator; and a refrigerant pipe by which the rotary compressor, the condenser, the expansion device and the evaporator communicate, wherein the rotary compressor comprises:

a cylinder comprising a cylinder chamber;

a roller which is housed in the cylinder chamber and eccentrically rotates by rotation of a rotational axis;

a first vane and a second vane which come into contact with the roller, reciprocate, partition the cylinder chamber into a compression side and an absorption side and overlap each other in an axial direction of the rotational axis; and a coil spring which biases the first and second vanes toward the roller, first protrusion portions having an equal length in the axial direction are provided on both end sides of a posterior end portion of the first vane along the axial direction, second protrusion portions having an equal length in the axial direction are provided on both end sides of a posterior end portion of the second vane along the axial direction, the first protrusion portions and the second protrusion portions protrude to the soil spring side, and the first and second vanes are attached to the coil spring by overlapping the first protrusion portion of the first vane in an end portion on the second vane side in the axial direction with the second protrusion portion of the second vane in an end portion on the first vane side in the axial direction and fitting the overlapped protrusion portions into the coil spring.

8. The rotary compressor of claim 7, wherein the first vane has a same shape as the second vane.

* * * * *